US010632511B2

(12) United States Patent
Patterson et al.

(10) Patent No.: US 10,632,511 B2
(45) Date of Patent: Apr. 28, 2020

(54) CLEANING DEVICE AND METHODS FOR USE

(71) Applicants: Matthew Patterson, Oak Lawn, IL (US); Brian Durnell, Oak Forest, IL (US)

(72) Inventors: Matthew Patterson, Oak Lawn, IL (US); Brian Durnell, Oak Forest, IL (US)

( * ) Notice: Subject to any disclaimer, the term of this patent is extended or adjusted under 35 U.S.C. 154(b) by 272 days.

(21) Appl. No.: 15/444,563

(22) Filed: Feb. 28, 2017

(65) Prior Publication Data

US 2018/0242722 A1 Aug. 30, 2018

(51) Int. Cl.

| | |
|---|---|
| ***B08B 9/08*** | (2006.01) |
| ***B08B 9/087*** | (2006.01) |
| ***A46B 7/04*** | (2006.01) |
| ***A46B 13/00*** | (2006.01) |
| ***A46B 13/02*** | (2006.01) |

(52) U.S. Cl.

CPC ..... *B08B 9/0808* (2013.01); *A46B 7/04* (2013.01); *A46B 7/042* (2013.01); *A46B 13/001* (2013.01); *B08B 9/087* (2013.01); *A46B 13/02* (2013.01); *A46B 2200/3006* (2013.01)

(58) Field of Classification Search

CPC ..... B08B 9/0808; B08B 9/087; B08B 9/36; A47L 15/0068; A47L 15/37; A47L 15/39; A47L 17/00; A47L 17/04; A47L 17/06; A47L 17/08; A46B 7/04; A46B 7/042; A46B 7/044; A46B 7/06; A46B 9/00; A46B 9/005; A46B 9/02; A46B 9/026; A46B 9/028; A46B 13/00; A46B 13/001; A46B 13/02; A46B 13/08; A46B 2200/3006; A46B 2200/3033

USPC ..... 15/56–59, 65, 71–73, 75, 76, 101, 164, 15/165, 179, 211–213, 230, 230.18, 15/230.19

See application file for complete search history.

(56) References Cited

U.S. PATENT DOCUMENTS

| | | | | | |
|---|---|---|---|---|---|
| 287,719 | A | * | 10/1883 | Quinn | 15/72 |
| 526,970 | A | * | 10/1894 | Hebb | 15/56 |
| 565,632 | A | * | 8/1896 | Pawlik | 15/72 |
| 653,144 | A | * | 7/1900 | Marwitz | 15/72 |

(Continued)

FOREIGN PATENT DOCUMENTS

| | | | |
|---|---|---|---|
| CN | 201332976 | Y | 10/2009 |
| CN | 201367563 | Y | 12/2009 |

(Continued)

*Primary Examiner* — Mark Spisich

(74) *Attorney, Agent, or Firm* — McDonnell Boehnen Hulbert & Berghoff LLP

(57) ABSTRACT

The present disclosure provides a device for cleaning a cylindrical container, such as a bucket. The device includes a drive shaft having a first end and a second end. The device also includes a frame including a horizontal component, a first vertical component, and a second vertical component, where each of the horizontal component, the first vertical component, and the second vertical component have a first surface and a second surface, and where the second end of the drive shaft is centrally coupled to the frame. Further, the device includes a cleaning component coupled to the second surface of each of the horizontal component, the first vertical component, and the second vertical component of the frame.

13 Claims, 12 Drawing Sheets

(56) References Cited

U.S. PATENT DOCUMENTS 1,009,170 A * 11/1911 Owens ..... B08B 9/0839 15/72
1,539,718 A * 5/1925 Crum ..... A47L 17/04 15/56
1,564,388 A * 12/1925 Westvig ..... A47L 17/00 15/164
1,748,241 A * 2/1930 Milos ..... A46B 5/00 15/165
1,826,942 A * 10/1931 Mackres ..... A47L 15/0068 15/101
2,532,925 A * 12/1950 Loeb ..... A47L 15/0068 134/115 R
2,696,625 A * 12/1954 Pendleton ..... B08B 9/0839 15/183
3,372,418 A * 3/1968 Di Ilio ..... A47L 17/04 15/165
4,231,132 A * 11/1980 Watanabe ..... B08B 9/087 15/179
7,200,891 B1 4/2007 McCulloch
8,607,397 B1 12/2013 Caver
2002/0112301 A1* 8/2002 Lee ..... A46B 5/06 15/164
2014/0127986 A1 5/2014 Cady

FOREIGN PATENT DOCUMENTS

CN 201759018 U 3/2011
CN 202077793 U 12/2011
CN 202116005 U 1/2012
CN 202238795 U 5/2012
CN 202298529 U 7/2012
CN 202703537 U 1/2013
DE 19602406 C1 1/1997
DE 19905871 * 8/2000
FR 1578754 * 8/1969
JP 2001-38317 * 2/2001
KR 100914558 B1 9/2009

* cited by examiner

CLEANING DEVICE AND METHODS FOR USE

BACKGROUND

Unless otherwise indicated herein, the materials described in this section are not prior art to the claims in this application and are not admitted to be prior art by inclusion in this section.

Cylindrical containers, such as buckets, are a common sight on any construction project. Many times, such cylindrical containers may include a material such as mortar, paint, spackle, grout, plaster, or other building materials. At the end of the day, these cylindrical containers must be cleaned to remove the material from the interior surface of the bucket and preserve the lifespan of the bucket. However, with the large number of cylindrical containers used on any given worksite, this is a time consuming, inefficient and therefore costly process. Accordingly, there remains a need for a device enabling a rapid and efficient method for cleaning cylindrical containers.

SUMMARY

Example devices and methods described herein describe various devices and methods for cleaning buckets and other cylindrical containers. Such devices and methods will provide a quick and efficient way to clean up a worksite at the end of the day.

Thus, in one aspect, a device is provided. The device includes a drive shaft having a first end and a second end. The device also includes a frame including a horizontal component, a first vertical component, and a second vertical component, where each of the horizontal component, the first vertical component, and the second vertical component have a first surface and a second surface, and where the second end of the drive shaft is centrally coupled to the frame. Further, the device includes a cleaning component coupled to the second surface of each of the horizontal component, the first vertical component, and the second vertical component of the frame.

In one embodiment of the first aspect, the cleaning component comprises a brush including a plurality of bristles.

In another embodiment of the first aspect, the cleaning component comprises a microfiber material.

In another embodiment of the first aspect, the first vertical component and the second vertical component are substantially perpendicular to the horizontal component.

In another embodiment of the first aspect, the cleaning component is removably coupled to the frame. In one example of such an embodiment, the first vertical component and the second vertical component of the frame each include a coupling mechanism, and wherein the cleaning component includes one or more complementary coupling mechanisms to removably couple the cleaning component to the frame.

In another embodiment of the first aspect, the frame further comprises a second horizontal component having a first end coupled to the first vertical component of the frame and a second end coupled to the second vertical component of the frame, and wherein the drive shaft is centrally coupled to the second horizontal component.

In another embodiment of the first aspect, the frame further comprises a second horizontal component, a third horizontal component, a third vertical component, and a fourth vertical component, wherein a first end of the second horizontal component is coupled to the first vertical component of the frame and a second end of the second horizontal component is coupled to a first end of the third vertical component, wherein a first end of the third horizontal component is coupled to the second vertical component of the frame and a second end of the second horizontal component is coupled to a first end of the fourth vertical component, wherein a second end of the third vertical component is coupled to the horizontal component of the frame, and wherein a second end of the fourth vertical component is coupled to the horizontal component of the frame.

In another embodiment of the first aspect, the device further includes a lid including a hole, wherein the drive shaft is configured to be positioned through the hole. In one example of such an embodiment, the lid is transparent.

In another embodiment of the first aspect, the device further includes a motor coupled to the drive shaft such that a rotation of the motor corresponds to a rotation of the drive shaft.

In another embodiment of the first aspect, the drive shaft and the frame are dimensioned such that a width of the cleaning component on the second surface of the frame is approximately equal to a diameter of a 5 gallon bucket.

In another embodiment of the first aspect, the drive shaft and the frame are dimensioned such that a width of the cleaning component on the second surface of the frame is approximately equal to a diameter of a 55 gallon drum.

In another embodiment of the first aspect, the first end of the drive shaft is configured to be attached to a drill.

In a second aspect, another device is provided. The device includes a drive shaft having a first end and a second end. The device also includes a frame having a first horizontal component, a second horizontal component, a first vertical component, and a second vertical component. The second end of the drive shaft is centrally coupled to the first horizontal component, and the drive shaft is centrally coupled to the second horizontal component between the second end of the drive shaft and the first end of the drive shaft. The second horizontal component includes a twist on each side of the centrally coupled drive shaft. The first vertical component and the second vertical component each include a coupling mechanism.

In one embodiment of the second aspect, the coupling mechanism of the first vertical component and the second vertical component are configured to receive a complementary coupling mechanism of a cleaning component to thereby removably couple the frame to the cleaning component. In one example of such an embodiment, the coupling mechanism of the first vertical component and the second vertical component comprises a hole, and the coupling mechanism of the cleaning component comprises a protrusion configured to be positioned in the hole.

In a third aspect, a cleaning component is provided. The cleaning component includes a horizontal component, a first vertical component, and a second vertical component. Each of the horizontal component, the first vertical component, and the second vertical component have a first surface and a second surface. At least a portion of the second surface of each of the horizontal component, the first vertical component, and the second vertical component includes a cleaning material. The second surface of each of the horizontal component, the first vertical component, and the second vertical component includes a channel. The first vertical component and the second vertical component each include a coupling mechanism.

In one embodiment of the third aspect, the channel is configured to receive a frame, and the coupling mechanism of the first vertical component and the second vertical component of the cleaning component are configured to receive a complementary coupling mechanism of the frame to thereby removably couple the frame to the cleaning component. In one example of such an embodiment, the coupling mechanism of the first vertical component and the second vertical component of the cleaning component comprises a protrusion, and the coupling mechanism of the frame comprises a hole configured to receive the protrusion.

In a fourth aspect, another device is provided. The device includes a drive shaft having a first end and a second end. The device also includes a circular frame having a first surface and a second surface, wherein the circular frame includes a horizontal component and a circular vertical component, and wherein the second end of the drive shaft is centrally coupled to the first surface of the horizontal component of the circular frame. Further, the device includes a cleaning component coupled to the second surface of the circular frame on each of the horizontal component and the circular vertical component of the circular frame.

In a fifth aspect, a method is provided. The method may include (a) loading the device according to the first or second aspect above into a cylindrical container, (b) coupling the first end of the drive shaft to a motor, (c) activating the motor such that a rotation of the motor is translated to a rotation of the drive shaft, and (d) moving the device up and down while the frame of the device is positioned in the cylindrical container.

These as well as other aspects, advantages, and alternatives, will become apparent to those of ordinary skill in the art by reading the following detailed description, with reference where appropriate to the accompanying drawings.

DETAILED DESCRIPTION

Example methods and systems are described herein. It should be understood that the words "example," "exemplary," and "illustrative" are used herein to mean "serving as an example, instance, or illustration." Any embodiment or feature described herein as being an "example," being "exemplary," or being "illustrative" is not necessarily to be construed as preferred or advantageous over other embodiments or features. The example embodiments described herein are not meant to be limiting. It will be readily understood that the aspects of the present disclosure, as generally described herein, and illustrated in the figures, can be arranged, substituted, combined, separated, and designed in a wide variety of different configurations, all of which are explicitly contemplated herein.

Furthermore, the particular arrangements shown in the Figures should not be viewed as limiting. It should be understood that other embodiments may include more or less of each element shown in a given Figure. Further, some of the illustrated elements may be combined or omitted. Yet further, an example embodiment may include elements that are not illustrated in the Figures.

Figure 1:
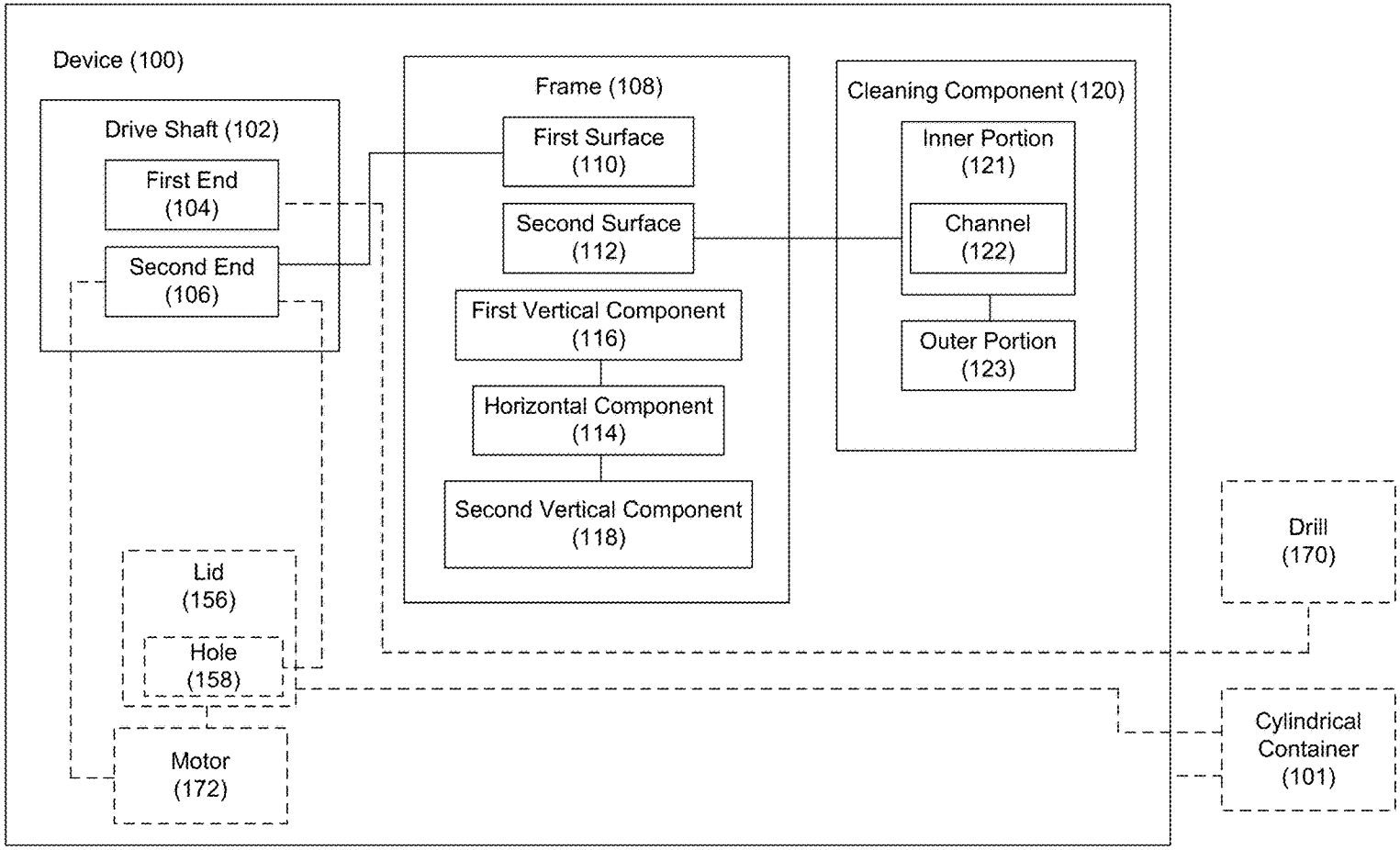
FIG. 1 is a block diagram of a device, according to an example embodiment.

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

Figure 11:
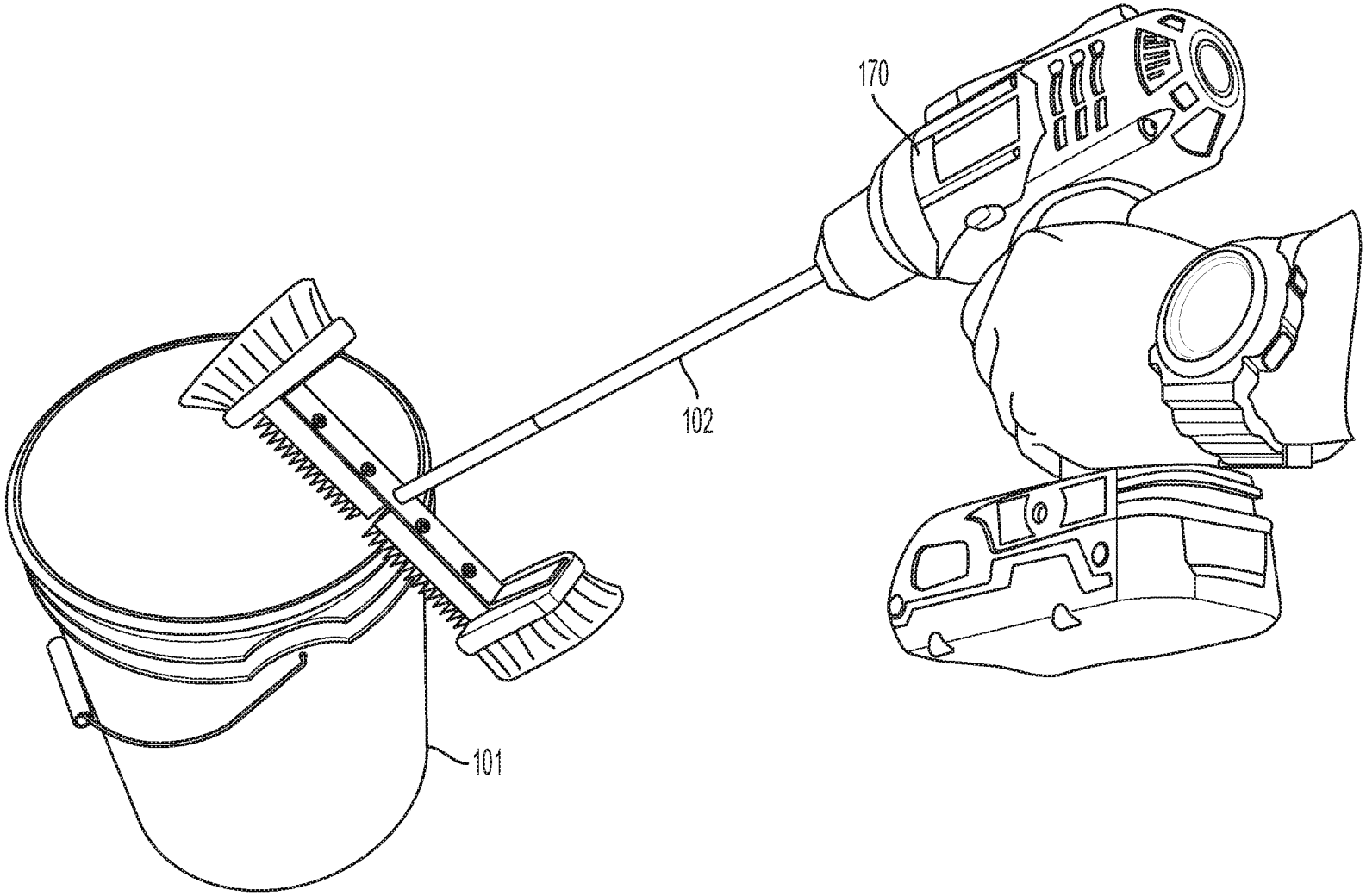
FIG. 11 is a perspective view of the device attached to a drill, according to an example embodiment.
Figure 13:
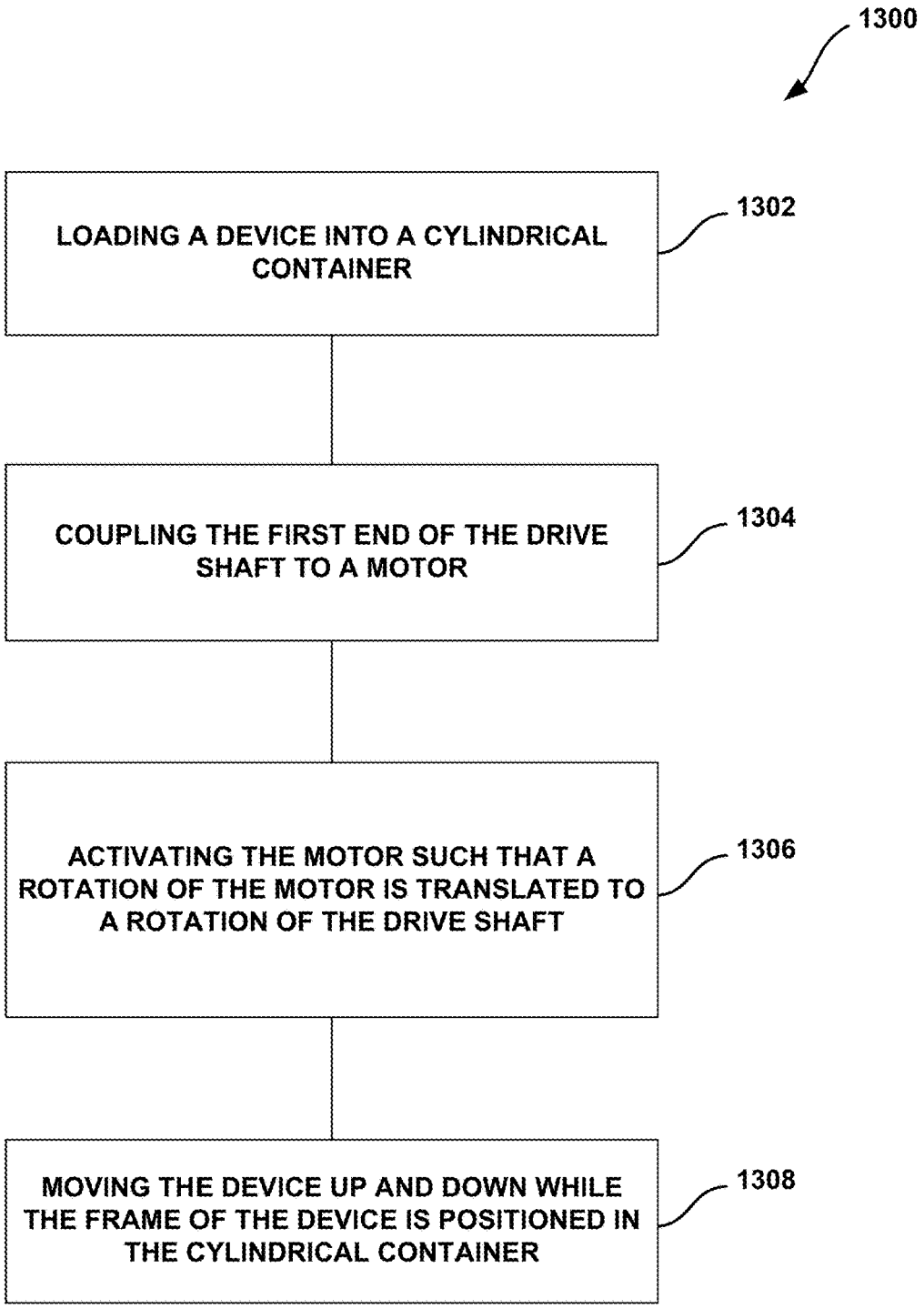
FIG. 13 is a flowchart illustrating an example method, according to an example embodiment.

In FIG. 13, referred to above, the blocks may represent operations and/or portions thereof and lines connecting the various blocks do not imply any particular order or dependency of the operations or portions thereof. It will be understood that not all dependencies among the various disclosed operations are necessarily represented. FIG. 11 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

As used herein, with respect to measurements, "about" or "substantially" means +/−5%.

The present disclosure provides devices and methods for cleaning cylindrical containers, such as buckets, canisters, barrels, tanks, bins, cans, bowls, or pipes. These cylindrical containers may include mortar, paint, spackle, grout, plaster, or other building materials.

Referring generally to FIG. 1 and particularly to, e.g., FIGS. 2-12, a device 100 for cleaning a cylindrical container 101, such as a bucket, is disclosed. In particular, the device 100 may include a drive shaft 102 having a first end 104 and a second end 106. The frame 108 may be made from or include any suitable material, including, but not limited to, aluminum, plated steel, zinc-plated steel, stainless steel, galvanized metal, electroplated metal, hot-dipped galvanized metal, plastics, and/or composites, as examples. The frame 108 may further include a horizontal component 114, a first vertical component 116, and a second vertical component 118. Each of the horizontal component 114, the first vertical component 116, and the second vertical component 118 have a first surface 110 and a second surface 112. In the examples shown in FIGS. 2-5, the first vertical component 116 and the second vertical component 118 of the frame 108 are substantially perpendicular to the horizontal component 114 of the frame 108.

Figure 2:
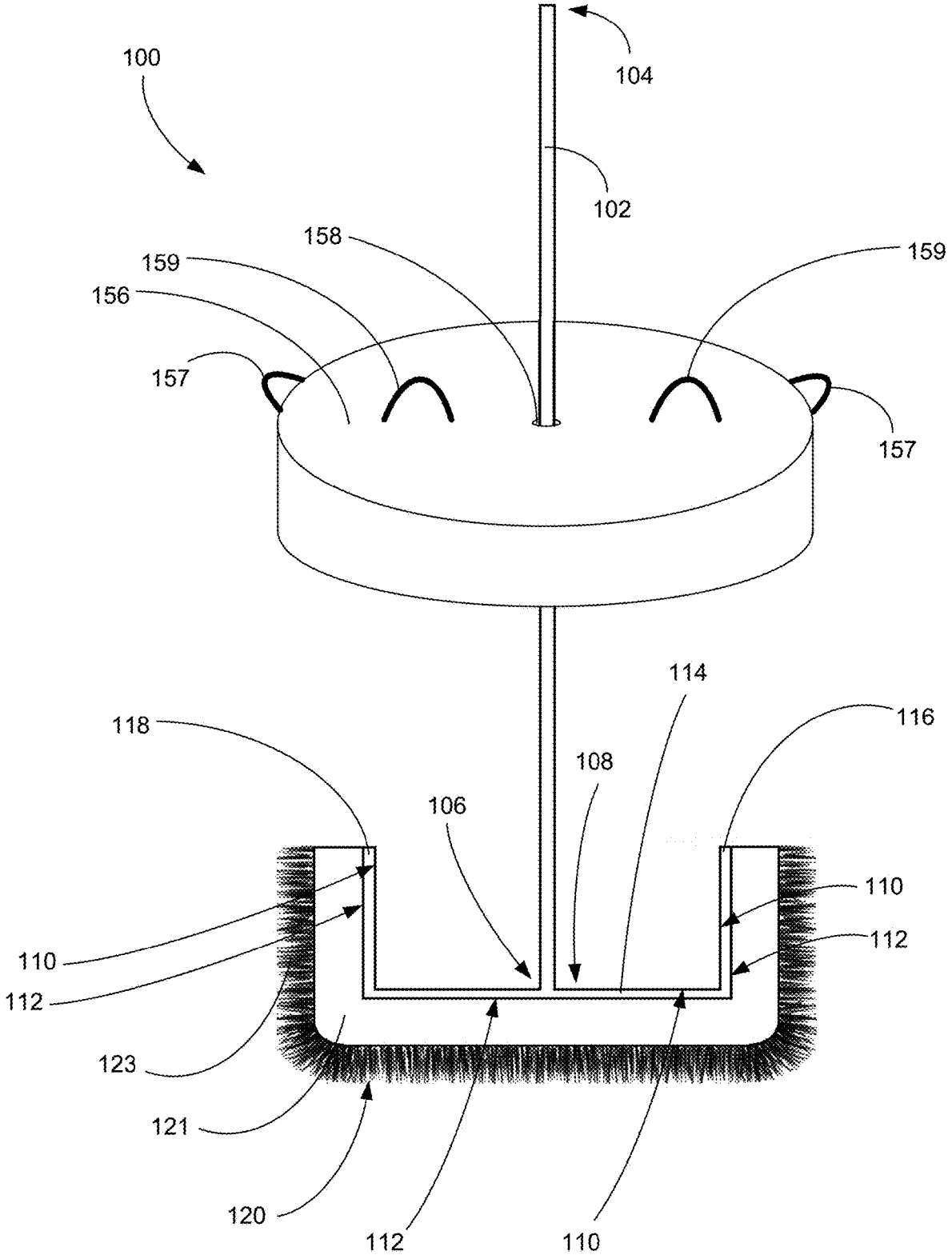
FIG. 2 is a cross-section view of a device, according to an example embodiment.

The second end 106 of the drive shaft 102 is centrally coupled to the frame 108. In one example, as shown in FIG. 2, the drive shaft 102 is centrally coupled to the first surface 110 of the horizontal component 114 of the frame 108. The drive shaft 102 may be coupled to the frame 108 in a variety of ways. In one example, the second end 106 of the drive shaft may be welded to the first surface 110 of the horizontal component 114 of the frame 108. In another example, the first surface 110 of the horizontal component 114 of the frame 108 may include a hole through which the second end 106 of the drive shaft 102 may be press fit. In yet another example, the first surface 110 of the horizontal component 114 of the frame 108 may include a set screw hole, and the second end 106 of the drive shaft 102 may inserted into the set screw hole and then the set screw may be tightened to thereby secure the drive shaft 102 to the frame 108. In yet another example, the drive shaft 102 may be an integral piece of the frame 108, such that they are form together as a single component during manufacturing. For example, the drive shaft 102 and the frame 108 may be sand cast from the same material using a single mold. Other examples for coupling the drive shaft 102 to the frame 108 are possible as well.

The device 100 may further include a cleaning component 120 coupled to the second surface 112 of each of the horizontal component 114, the first vertical component 116, and the second vertical component 118 of the frame 108. In one example, the cleaning component 120 comprises a brush including a plurality of bristles. In another example, the cleaning component 120 comprises a microfiber material. Other example cleaning components are possible as well. Further, as shown in FIGS. 2-5, the cleaning component 120 may include an inner portion 121 and an outer portion 123. The inner portion 121 of the cleaning component 120 may be more rigid than the outer portion 123, and may be directly coupled to the frame 108. The outer portion 123 of the cleaning component 120 may include bristles, microfiber, or any other cleaning material that is configured to contact the inner surface of the cylindrical container 101 to thereby clean the cylindrical container 101 when the device 100 is in use.

Figure 5:
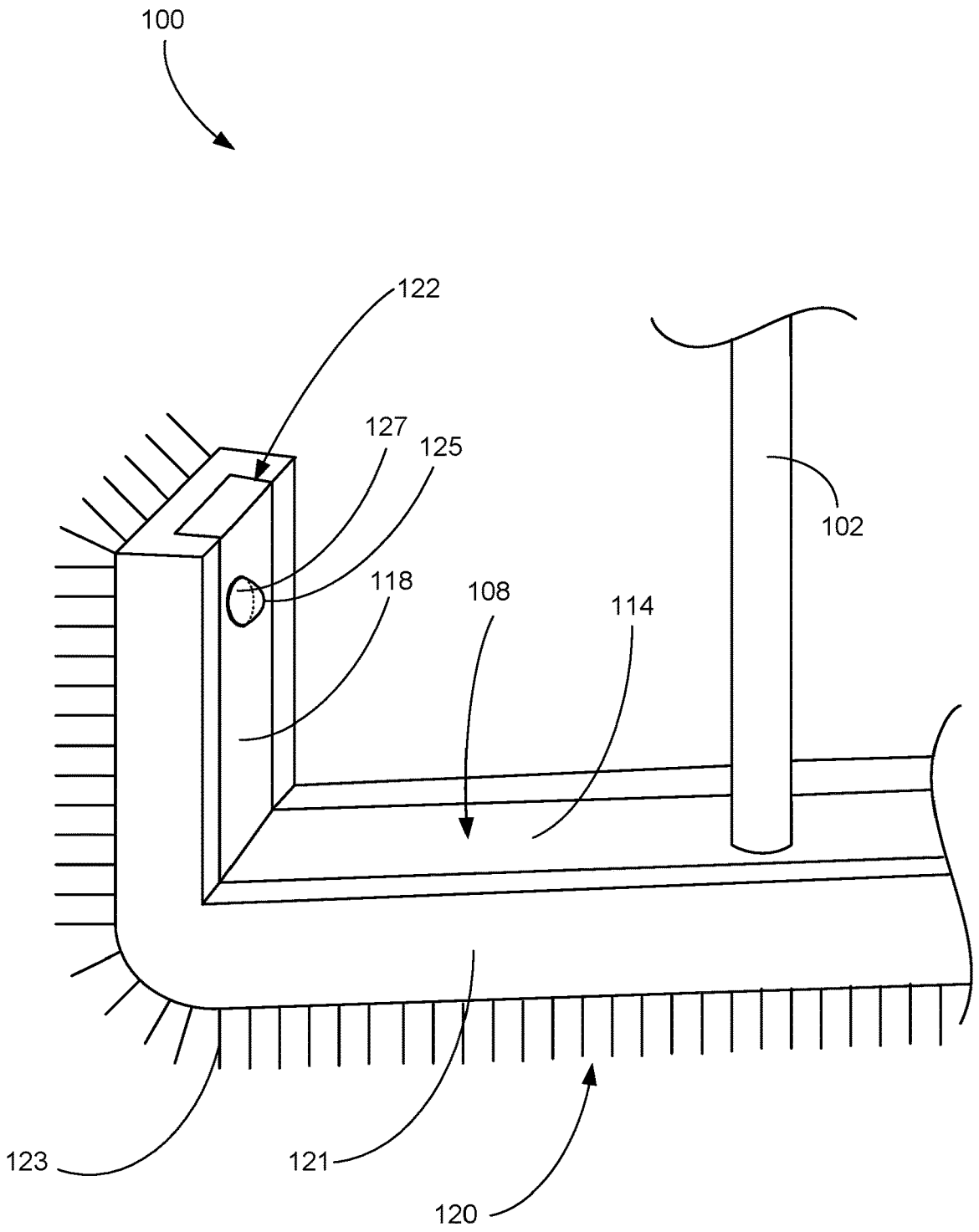
FIG. 5 is a perspective view of a device, according to an example embodiment.
Figure 6A:
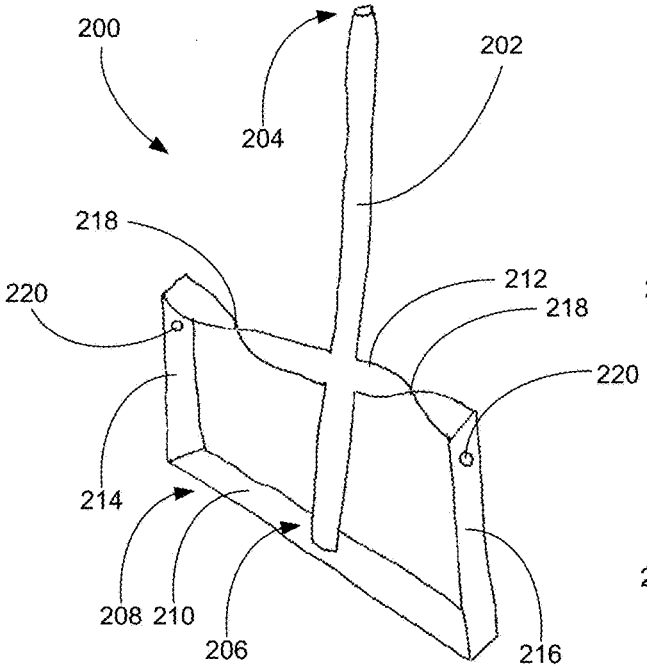
FIG. 6A is a perspective view of a device, according to an example embodiment
Figure 6B:
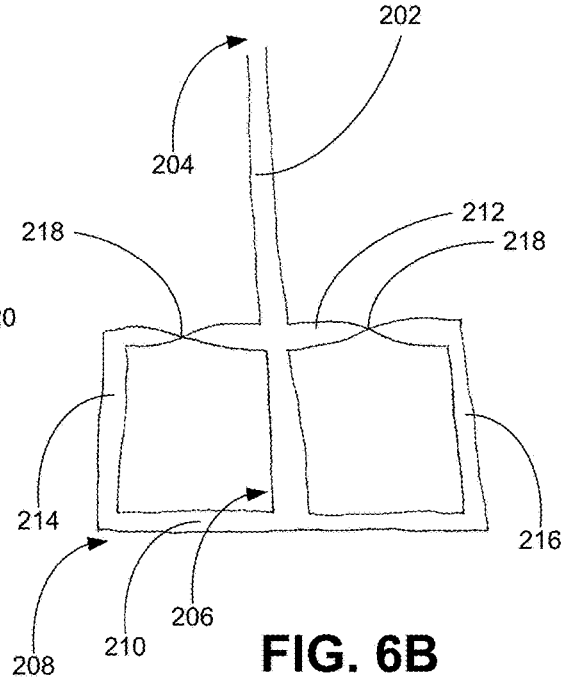
FIG. 6B is a side view of the device of FIG. 6A, according to an example embodiment.
Figure 6C:
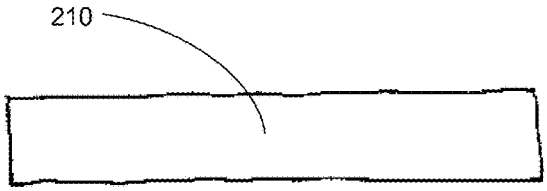
FIG. 6C is a bottom view of the device of FIG. 6A, according to an example embodiment.
Figure 6D:
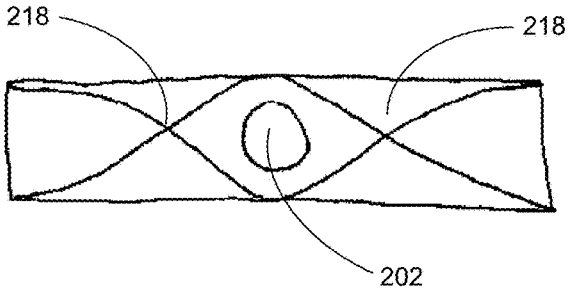
FIG. 6D is a top view of the device of FIG. 6A, according to an example embodiment.
Figure 6E:
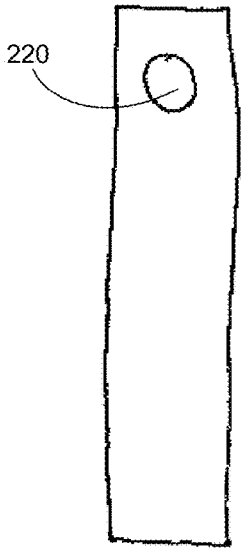
FIG. 6E is a side view of the device of FIG. 6A, according to an example embodiment.
Figure 7A:
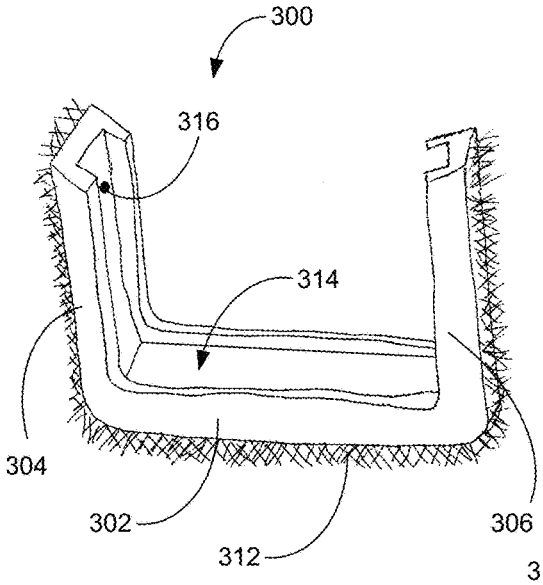
FIG. 7A is a perspective view of a cleaning component, according to an example embodiment.
Figure 7B:
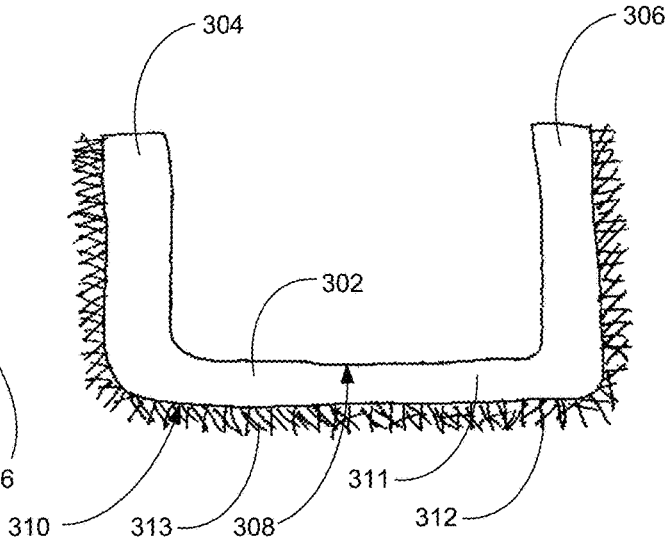
FIG. 7B is a side view of the cleaning component of FIG. 7A, according to an example embodiment.
Figure 7C:
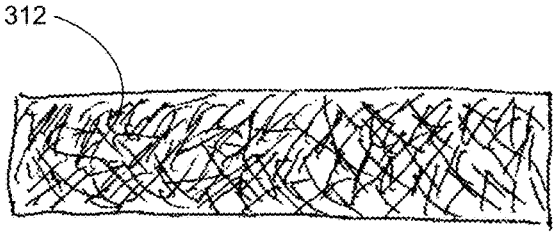
FIG. 7C is a bottom view of the cleaning component of FIG. 7A, according to an example embodiment.
Figure 7D:
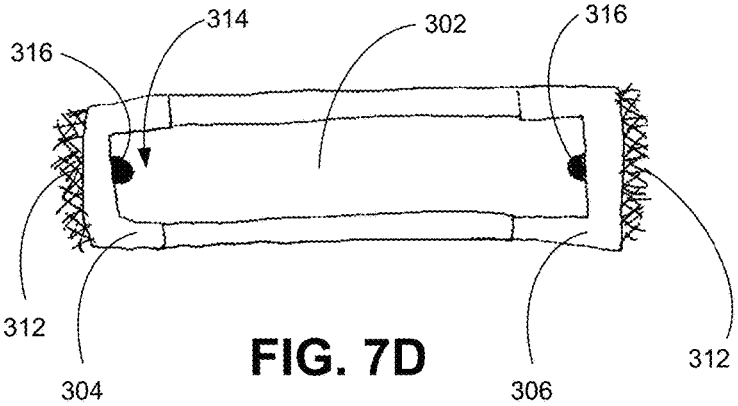
FIG. 7D is a top view of the cleaning component of FIG. 7A, according to an example embodiment.
Figure 7E:
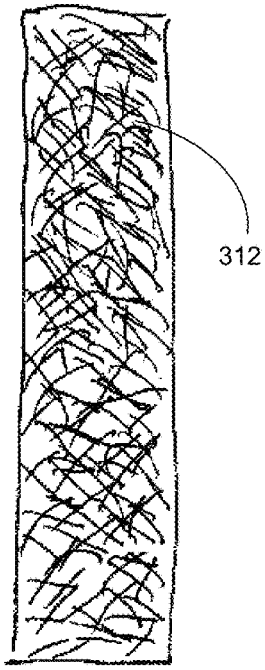
FIG. 7E is a side view of the cleaning component of FIG. 7A, according to an example embodiment.

In one example, the cleaning component 120 is permanently fixed to the frame 108, through one or more screws, one or more nails, or glue, as examples. In another example, the cleaning component 120 is removably coupled to the frame 108. In such an example, the second surface 112 of the frame 108 may include a channel into which the cleaning component 120 may be press fit. In another example, the frame 108 and cleaning component 120 may each include a through hole, and a threaded bolt may be passed through the through hole and secured with a nut to removably couple the cleaning component 120 to the frame. In another example, as shown in FIG. 5, the cleaning component 120 may include a channel 122 into which the frame 108 is press fit.

In yet another example, the first vertical component 116 and the second vertical component 118 of the frame 108 each include a coupling mechanism 125, and the cleaning component 120 includes one or more complementary coupling mechanisms 127 to removably couple the cleaning component 120 to the frame 108. In one particular example, as shown in FIG. 5, the coupling mechanism of the first vertical component 116 of the frame 108 and the second vertical component 118 of the frame 108 comprises a hole 125, and the coupling mechanism of the cleaning component 120 comprises a protrusion 127 configured to be positioned in the hole 125. In another example, the coupling mechanism of the first vertical component 116 of the frame 108 and the second vertical component 118 of the frame 108 comprises a protrusion, and the coupling mechanism of the cleaning component 120 comprises a hole configured to receive the protrusion of the frame 108. In yet another example, the coupling mechanism of the first vertical component 116 of the frame 108 and the second vertical component 118 of the frame 108 comprises a magnet, and the coupling mechanism of the cleaning component 120 comprises a complementary magnet configured to attract the magnet of the frame 108. In yet another example, the coupling mechanism of the first vertical component 116 of the frame 108 and the second vertical component 118 of the frame 108 comprises a latch, and the coupling mechanism of the cleaning component 120 comprises a buckle configured to receive the latch. Other examples for removably coupling the frame 108 to the cleaning component 120 are possible as well, as discussed in additional detail below. Such an arrangement may enable a user to replace the cleaning component 120 after a number of uses, or may enable a user to wash the cleaning component 120 between uses.

Figure 3:
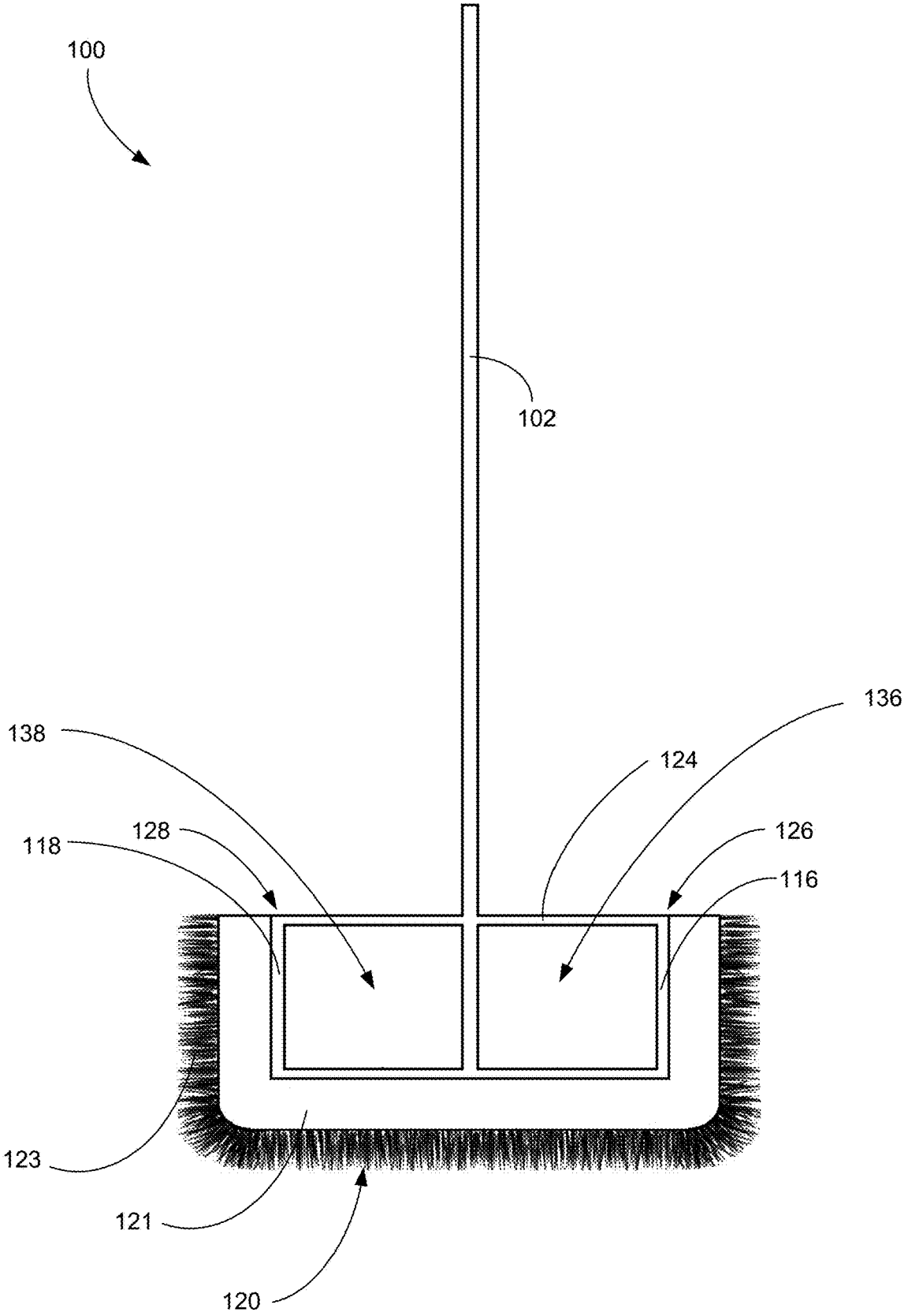
FIG. 3 is a cross-section view of another device, according to an example embodiment.

In the example shown in FIG. 3, the frame 108 further comprises a second horizontal component 124 having a first end 126 coupled to the first vertical component 116 of the frame 108 and a second end 128 coupled to the second vertical component 118. In such an embodiment, the drive shaft 102 is centrally coupled to the second horizontal component 124 between the first end 104 of the drive shaft 102 and the second end 106 of the drive shaft 102. Such an arrangement creates a first void 136 and a second void 138 in the frame 108. These voids 136, 138 allow for the material present in the cylindrical container 101 to circulate properly during cleaning. In addition, by removing the cleaning component 120 as discussed above, the frame 108 including the voids 136, 138 may transform from a cleaning device to a mixing bit to mix mortar, paint, and other materials on the worksite, as discussed in additional detail below.

Figure 4:
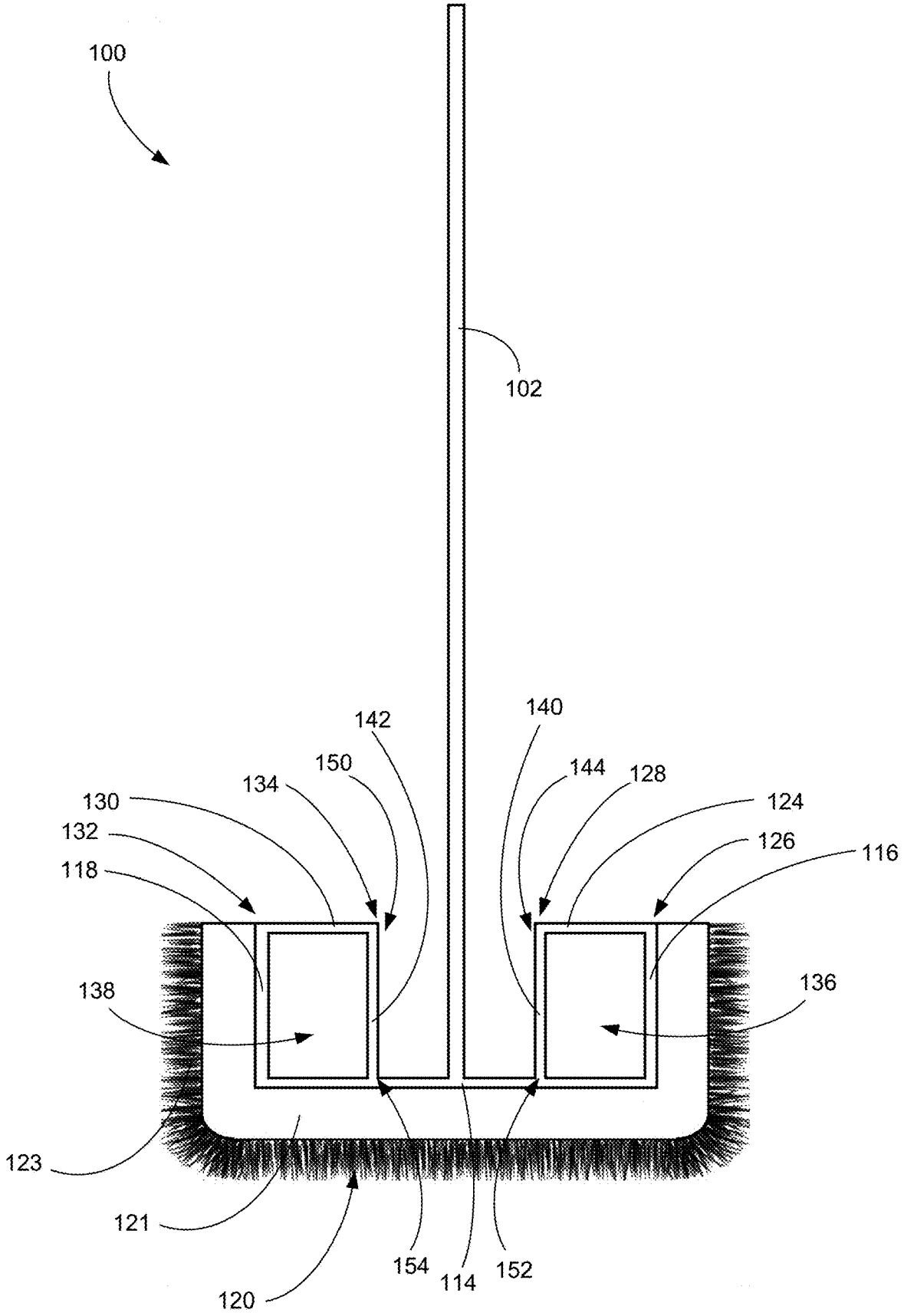
FIG. 4 is a cross-section view of another device, according to an example embodiment.

In the example shown in FIG. 4, the frame 108 further comprises a second horizontal component 124, a third horizontal component 130, a third vertical component 140, and a fourth vertical component 142. In such an example, a first end 126 of the second horizontal component 124 is coupled to the first vertical component 116 of the frame 108 and a second end 128 of the second horizontal component 124 is coupled to a first end 144 of the third vertical component 140. In addition, a first end 132 of the third horizontal component 130 is coupled to the second vertical component 118 of the frame 108 and a second end 134 of the third horizontal component 130 is coupled to a first end 150 of the fourth vertical component 142. Further, a second end 152 of the third vertical component 140 is coupled to the first horizontal component 114 of the frame 108, and a second end 154 of the fourth vertical component 142 is coupled to the first horizontal component 114 of the frame 108. Similar to the design in FIG. 3, such an arrangement creates a first void 136 and a second void 138 in the frame 108. These voids 136, 138 allow for the material present in the cylindrical container 101 to circulate properly during cleaning. In addition, by removing the cleaning component 120 as discussed above, the frame 108 including the voids 136, 138 may transform from a cleaning device to a mixing bit to mix mortar, paint, and other materials on the worksite, as discussed in additional detail below.

In another example, the device 100 may include a second horizontal component substantially perpendicular to the horizontal component 114, a third vertical component extending vertically from one end of the second horizontal component, and a fourth vertical component extending vertically from the other end of the second horizontal component. In such an embodiment, the drive shaft 102 may be centrally coupled to both the horizontal component 114 and the second horizontal component, such that the horizontal component 114 and the second horizontal component form a cross shape from a top view.

In one example, as shown in FIG. 2, the device 100 may further include a lid 156 including a hole 158, wherein the drive shaft 102 is configured to be positioned through the hole 158. The lid 156 may be sized to fit on a top of the cylindrical container 101. In one embodiment, the lid 156 may include a seal around the edge to securing fasten the lid 156 to the top of the cylindrical container 101. In one particular example, the lid 156 may be sized to fit a 5 gallon bucket. In another embodiment, the lid 156 may include one or more flaps 157 coupled to the edge of the lid 156, which may aid in removing the lid 156 from the top of the cylindrical container 101. In another embodiment, the lid 156 may include one or more handles 159 coupled to a top surface of the lid 156, which may aid in removing the lid 156 from the top of the cylindrical container 101. The lid 156 may be advantageous to prevent materials from exiting the cylindrical container 101 during use of the device 100. In one example, the lid 156 may be transparent so that a user can see whether or not the cylindrical container 101 is clean before ceasing use of the device 100.

FIGS. 6A-6E illustrate a device 200, according to another example embodiment. In particular, the device 200 includes a drive shaft 202 having a first end 204 and a second end 206. The device 200 also includes a frame 208 having a first horizontal component 210, a second horizontal component 212, a first vertical component 214, and a second vertical component 216. The second end 206 of the drive shaft 202 is centrally coupled to the first horizontal component 210, and the drive shaft 202 is centrally coupled to the second horizontal component 212 between the second end 206 of the drive shaft 202 and the first end 204 of the drive shaft 202. The drive shaft 202 may be coupled to the frame 208 in a variety of ways, as discussed above in relation to FIG. 2.

The second horizontal component 212 includes a twist 218 on each side of the centrally coupled drive shaft 202. The twist 218 provides advantageous mixing properties to mix mortar, paint, and other materials on the worksite. As such, the device 200 may be used as a mixing device, with the option of being coupled to the cleaning component 300 to be used as a cleaning device, as described in additional detail below. In one example, the twist 218 comprises a 180 degree twist from the vertical component 214, 216 to the drive shaft 202. In another example, the twist comprises a 360 degree twist from the vertical component 214, 216 to the drive shaft 202.

The first vertical component 214 and the second vertical component 216 each include a coupling mechanism 220. The coupling mechanism 220 of the first vertical component 214 and the second vertical component 216 are configured to receive a complementary coupling mechanism 316 of a cleaning component 300 to thereby removably couple the frame 208 to the cleaning component 300, as discussed in additional detail below.

FIGS. 7A-7E illustrate a cleaning component 300, according to another example embodiment. In particular, the cleaning component 300 comprising a horizontal component 302, a first vertical component 304, and a second vertical component 306. Each of the horizontal component 302, the first vertical component 304, and the second vertical component 306 include a first surface 308 and a second surface 310.

At least a portion of the second surface 310 of each of the horizontal component 302, the first vertical component 304, and the second vertical component 306 includes a cleaning material 312. The cleaning material 312 may comprise bristles, microfiber, or any other cleaning material that is configured to contact the inner surface of the cylindrical container 101 to thereby clean the cylindrical container 101 when the device 100 is in use. The cleaning material 312 may include, but is not limited to, polystyrene, flagged polystyrene, carbon steel wire, brass wire, Palmyra, Tampico, stainless steel wire, boar bristle, bassine fiber, bass fiber, Teflon®, horsehair, Tynex® "A" nylon, polyester, nylon, or microfiber. In one example, the cleaning material 312 on each of the horizontal component 302, the first vertical component 304, and the second vertical component 306 is the same. In another embodiment, the cleaning material 312 of the horizontal component 302 is different than the cleaning material 312 of the first vertical component 304 and the second vertical component 306. Such an arrangement may be advantageous if the bottom of the cylindrical container 101 has more material that needs cleaning than the sides of the cylindrical container 101. In such an example, the cleaning material 312 of the horizontal component 302 may be stiffer than the cleaning material 312 of the first vertical component 304 and the second vertical component 306. For example, the cleaning material 312 of the horizontal component 302 may comprise a stainless steel wire and the cleaning material 312 of the first vertical component 304 and the second vertical component 306 may comprise nylon. Other combinations of materials are possible as well.

The cleaning component 300 may include an inner portion 311 and an outer portion 313. The inner portion 311 of the cleaning component 300 may be more rigid than the outer portion 313, and may be directly coupled to the frame 208. The outer portion 313 of the cleaning component 300 may comprise the cleaning material 312 that is configured to contact the inner surface of the cylindrical container 101 to thereby clean the cylindrical container 101 when the device is in use. In one example, the inner portion 311 of the cleaning component 300 comprises a material that is flexible, such as plastic, or composites as examples. In such an embodiment, the first vertical component 304 and the second vertical component 306 may be configured to flex outwardly when the frame 208 is coupled to the cleaning component 300.

The second surface 310 of each of the horizontal component 302, the first vertical component 304, and the second vertical component 306 includes a channel 314. In one example, the edges of the channel 314 may be tapered towards the channel 314. The channel 314 may be configured to receive the frame 208 of the device 200 described above. The first vertical component 304 and the second vertical component 306 each include a coupling mechanism 316. In one example, the coupling mechanism 316 of the first vertical component 304 and the second vertical component 306 are each positioned inside of the channel 316. The coupling mechanism 316 of the first vertical component 304 of the cleaning component 300 and the second vertical component 306 of the cleaning component 300 are configured to receive a complementary coupling element 220 of the frame 208 to thereby removably couple the frame 208 to the cleaning component 300. Such an arrangement may be advantageous such that a user can use a particular cleaning component 300 having a particular cleaning material 312 with the frame 208 depending on the type of material to be cleaned. For example, a user may use a cleaning component 300 with a softer cleaning material 312 (e.g., nylon or microfiber) if the user is cleaning paint from the cylindrical container 101. In another example, the user may use a cleaning component 300 with a harder cleaning material 312 (e.g., steel wire) if the user is cleaning mortar from the cylindrical container 101.

The coupling mechanism 220 of the frame 208 and the complementary coupling mechanism 316 of the cleaning component 300 may take a variety of forms. In one particular example, the coupling mechanism 220 of the first vertical component 214 of the frame 208 and the second vertical component 216 of the frame 208 comprises a hole, and the complementary coupling mechanism 316 of the first vertical component 304 cleaning component 300 and the second vertical component 306 of the cleaning component 300 comprises a protrusion configured to be positioned in the hole. In another example, the coupling mechanism 220 of the first vertical component 214 of the frame 208 and the second vertical component 216 of the frame 208 comprises a protrusion, and the complementary coupling mechanism 316 of the first vertical component 304 cleaning component 300 and the second vertical component 306 of the cleaning component 300 comprises a hole configured to receive the protrusion of the frame 208. In another example, the coupling mechanism 220 of the first vertical component 214 of the frame 208 and the second vertical component 216 of the frame 208 comprises a first magnet, and the complementary coupling mechanism 316 of the first vertical component 304 cleaning component 300 and the second vertical component 306 of the cleaning component 300 comprises a second magnet configured to attract the first magnet. In yet another example, the coupling mechanism 220 of the first vertical component 214 of the frame 208 and the second vertical component 216 of the frame 208 comprises a latch, and the complementary coupling mechanism 316 of the first vertical component 304 cleaning component 300 and the second vertical component 306 of the cleaning component 300 comprises a buckle configured to receive the latch.

The above examples for removal coupling the frame 208 to the cleaning component 300 are merely illustrative, non-limiting examples. Other examples for removably coupling the frame 208 to the cleaning component 300 are possible as well. Such an arrangement may enable a user to replace the cleaning component 300 after a number of uses, or may enable a user to wash the cleaning component 300 between uses. In addition, a user may be able to switch out the cleaning component 300 based on the material to be cleaned, as discussed above.

Figure 8:
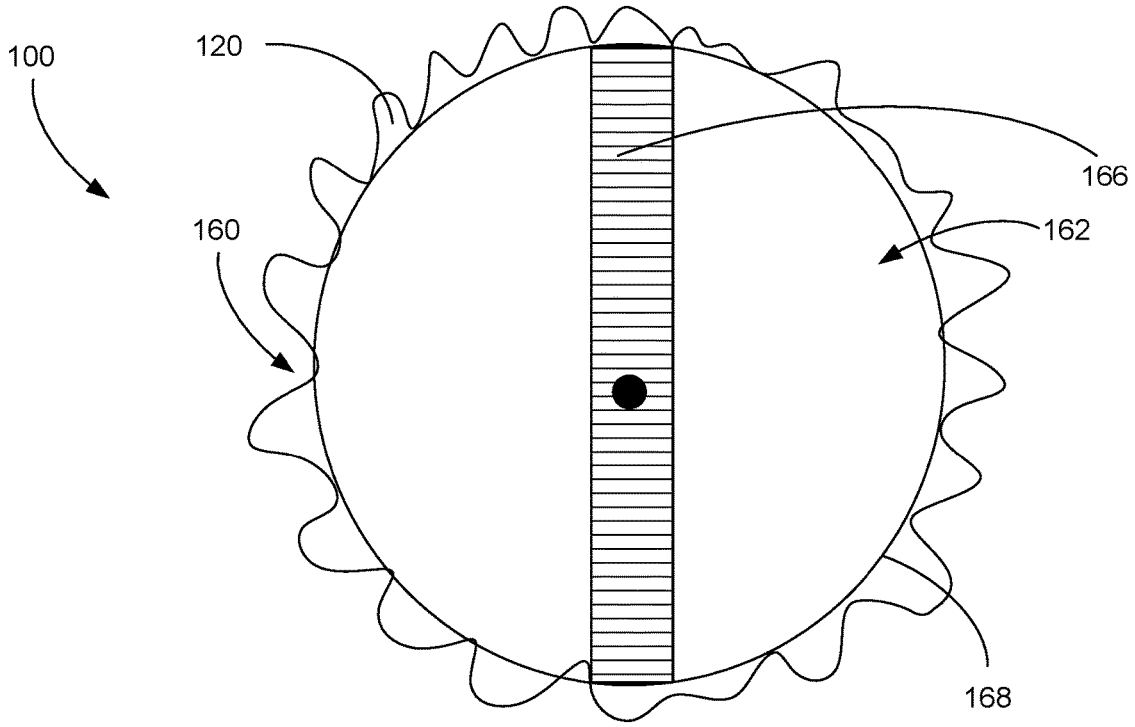
FIG. 8 is a top view of another device, according to an example embodiment.
Figure 9:
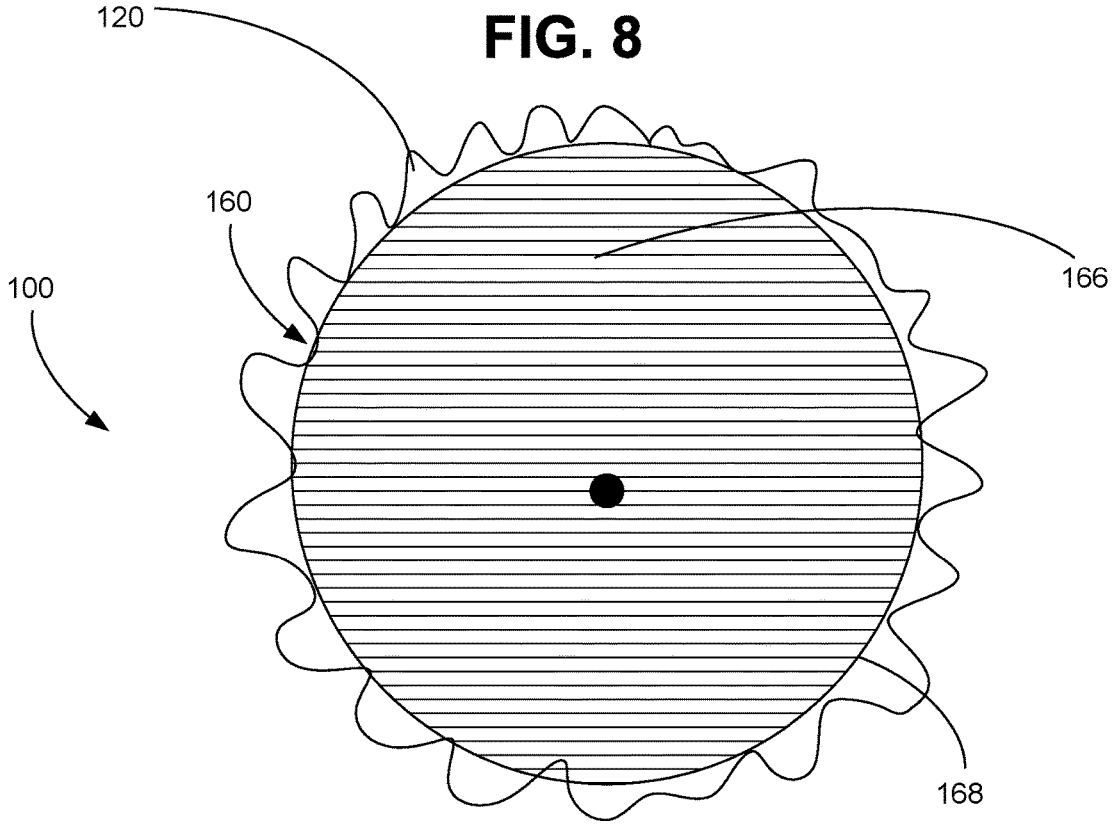
FIG. 9 is a top view of another device, according to an example embodiment.
Figure 10:
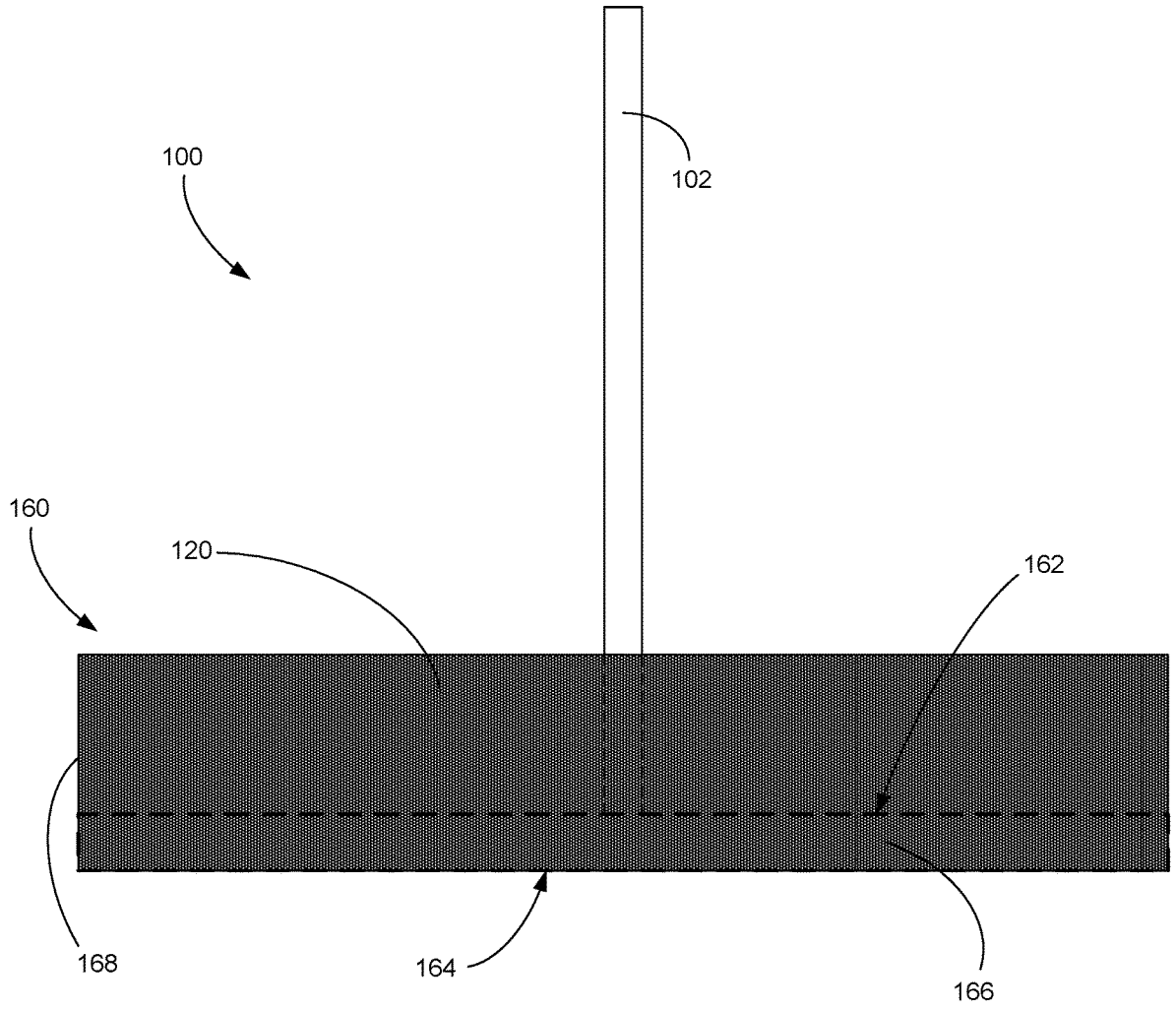
FIG. 10 is a side view of a device, according to an example embodiment.

In another example, as shown in FIGS. 8-10, the device 100 may include a drive shaft 102 having a first end 104 and a second end 106. The device 100 may also include a circular frame 160 having a first surface 162 and a second surface 164. The circular frame 160 includes a horizontal component 166 and a circular vertical component 168, and the second end 106 of the drive shaft 102 is centrally coupled to the first surface 162 of the horizontal component 166 of the circular frame 160. As shown in FIG. 10, the circular vertical component 168 is substantially perpendicular to the horizontal component 166. The device 100 may also include a cleaning component 120 coupled to the second surface 164 of the circular frame 160 on each of the horizontal component 166 and the circular vertical component 168 of the circular frame 160. In one example, as shown in FIG. 8, the horizontal component 166 is rectangular. In another example, as shown in FIG. 9, the horizontal component 166 is circular.

Figure 12:
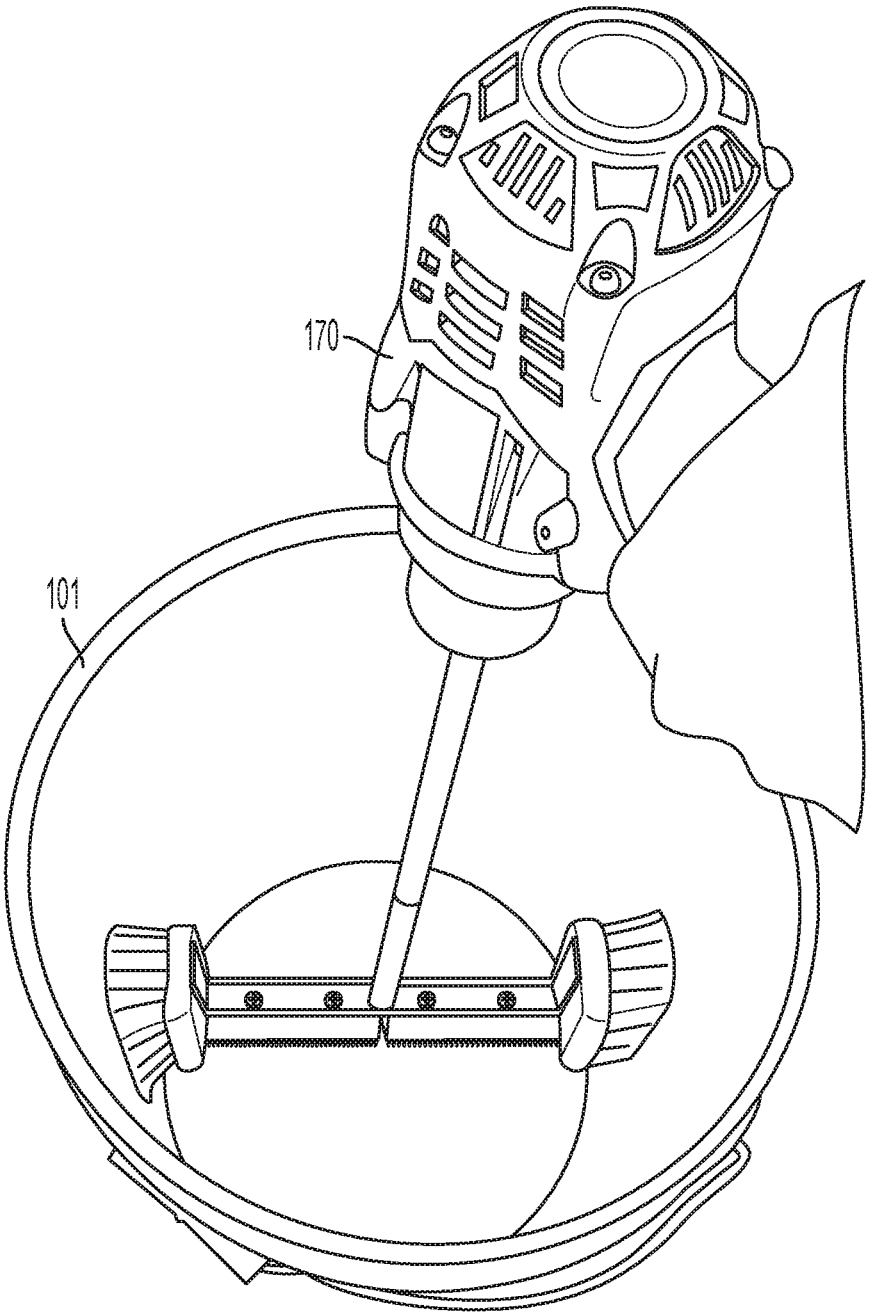
FIG. 12 is a top view of the device attached to a drill and positioned in a bucket, according to an example embodiment.

In one example, the first end 104 of the drive shaft 102 is configured to be attached to a drill 170, as shown in FIGS. 11 and 12. In such an embodiment, the draft shaft 102 may be dimensioned as a bit to fit in the drill 170. In one particular example, the drive shaft 102 may be a ½ inch hexagonal shaft. In such an embodiment, the hole 158 in the lid 156 may be hexagonal to receive the hexagonal shaft. The hexagonal hole may be surrounded by bearings to enable to the hexagonal hole to rotate along with the drive shaft 102 with respect to the lid 156. In another embodiment, the device 100 may further include a motor 172 coupled to the drive shaft 102 such that a rotation of the motor 172 corresponds to a rotation of the drive shaft 102. Such a motor 172 may be positioned on a top surface of the lid 156, for example. Other examples are possible as well.

In one example, the drive shaft 102 and the frame 108 are dimensioned such that a width of the cleaning component 120 on the second surface 112 of the frame 108 is approximately equal to a diameter of a 5 gallon bucket. In such an example, the drive shaft 102 may have a length of about 24 inches, and the width of the cleaning component 120 on the second surface 112 of the frame 108 is about 11 inches, and the height of the cleaning component 120 on the second surface 112 of the frame 108 is about 5 inches. Such dimensions are merely for illustrative purposes for one particular embodiment, and should not be considered limiting.

In another example, the drive shaft 102 and the frame 108 are dimensioned such that a width of the cleaning component 120 on the second surface 112 of the frame 108 is approximately equal to a diameter of a 55 gallon drum. In such an example, the drive shaft 102 may have a length of about 36 inches, and the width of the cleaning component 120 on the second surface 112 of the frame 108 is about 24 inches, and the height of the cleaning component 120 on the second surface 112 of the frame 108 is about 12 inches. Such dimensions are merely for illustrative purposes for one particular embodiment, and should not be considered limiting.

FIG. 13 is a block diagram of an example method for adjusting a fluid flow rate through a fluidic control device. Method 1100 shown in FIG. 13 presents an embodiment of a method that could be used by the devices of FIGS. 1-12, as an example. Method 1300 may include one or more operations, functions, or actions as illustrated by one or more of blocks 1302-1308. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

In addition, for the method 1100 and other processes and methods disclosed herein, the block diagram shows functionality and operation of one possible implementation of present embodiments. In this regard, each block may represent a module, a segment, or a portion of program code, which includes one or more instructions executable by a processor or computing device for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device.

Initially, at block 1302, the method 1300 includes loading a device into a cylindrical container. In one example, as illustrated in FIGS. 2-5, the device includes (i) a drive shaft having a first end and a second end, (ii) a frame having a first surface and a second surface, wherein the frame includes a horizontal component, a first vertical component, and a second vertical component, and wherein the second end of the drive shaft is centrally coupled to the first surface of the horizontal component of the frame, and (iii) a cleaning component coupled to the second surface of the frame on each of the horizontal component, the first vertical component, and the second vertical component of the frame. In another example, as illustrated in FIGS. 6-7, the device includes the device 200 removably coupled to the cleaning component 300. In yet another example, as illustrated in FIGS. 8-10, the device includes (i) a drive shaft having a first end and a second end, (ii) a circular frame having a first surface and a second surface, wherein the circular frame includes a horizontal component and a circular vertical component, and wherein the second end of the drive shaft is centrally coupled to the first surface of the horizontal component of the circular frame, and (iii) a cleaning component coupled to the second surface of the circular frame on each of the horizontal component and the circular vertical component of the circular frame.

At block 1304, the method 1300 includes coupling the first end of the drive shaft to a motor. As discussed above, in one example, the motor may be a hand held tool, such as a drill. In another example, the motor may be coupled to a lid that is positioned on top of the cylindrical container. Other example motors are possible as well.

At block 1306, the method 1300 includes activating the motor such that a rotation of the motor is translated to a rotation of the drive shaft. At block 1308, the method 1300 includes moving the device up and down while the frame of the device is positioned in the cylindrical container.

In one example, the method may further include adding water to the cylindrical container prior to the loading of the device. Further, the water may include a cleaning solution, to thereby make the cleaning of the cylindrical container even more efficient. In another example, the method may further include positioning a lid on the cylindrical container while passing the first end of the drive shaft through a hole in the lid prior to coupling the first end of the drive shaft to the motor. Such an arrangement may help prevent materials in the cylindrical container from splashing out into the worksite when the device is cleaning the cylindrical container. Other examples are possible as well.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location, or other structural elements described as independent structures may be combined.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

What is claimed is:

1. A device comprising:

a drive shaft having a first end and a second end;

a frame including a horizontal component, a first vertical component, and a second vertical component, wherein each of the horizontal component, the first vertical component, and the second vertical component have a first surface and a second surface, and wherein the second end of the drive shaft is centrally coupled to the frame; and a cleaning component including a channel, wherein the channel of the cleaning component contacts the second surface of each of the horizontal component, the first vertical component, and the second vertical component of the frame, wherein the cleaning component is removably coupled to the frame, wherein the first vertical component and the second vertical component each include one of a hole in the frame or a protrusion on the frame, and wherein the cleaning component includes a corresponding one of a protrusion on the cleaning component configured to be positioned in the hole of the frame or a hole in the cleaning component configured to receive the protrusion in the frame.

2. The device of claim 1, wherein the cleaning component comprises a brush including a plurality of bristles.

3. The device of claim 1, wherein the cleaning component comprises a microfiber material.

4. The device of claim 1, wherein the first vertical component and the second vertical component are substantially perpendicular to the horizontal component.

5. The device of claim 1, wherein the frame further comprises a second horizontal component having a first end coupled to the first vertical component of the frame and a second end coupled to the second vertical component of the frame, and wherein the drive shaft is centrally coupled to the second horizontal component.

6. The device of claim 1, wherein the frame further comprises a second horizontal component, a third horizontal component, a third vertical component, and a fourth vertical component, wherein a first end of the second horizontal component is coupled to the first vertical component of the frame and a second end of the second horizontal component is coupled to a first end of the third vertical component, wherein a first end of the third horizontal component is coupled to the second vertical component of the frame and a second end of the third horizontal component is coupled to a first end of the fourth vertical component, wherein a second end of the third vertical component is coupled to the horizontal component of the frame, and wherein a second end of the fourth vertical component is coupled to the horizontal component of the frame.

7. The device of claim 1, further comprising a lid including a hole, wherein the drive shaft is configured to be positioned through the hole.

8. The device of claim 7, wherein the lid is transparent.

9. The device of claim 1, further comprising a motor coupled to the drive shaft such that a rotation of the motor corresponds to a rotation of the drive shaft.

10. The device of claim 1, wherein the drive shaft and the frame are dimensioned such that a width of the cleaning component on the second surface of the frame is approximately 11 inches.

11. The device of claim 1, wherein the drive shaft and the frame are dimensioned such that a width of the cleaning component on the second surface of the frame is approximately 24 inches.

12. The device of claim 1, wherein the first end of the drive shaft is configured to be attached to a drill.

13. A cleaning component comprising:

a horizontal component;

a first vertical component; and a second vertical component, wherein each of the horizontal component, the first vertical component, and the second vertical component have a first surface and a second surface, wherein at least a portion of the second surface of each of the horizontal component, the first vertical component, and the second vertical component includes a cleaning material, wherein the first surface of each of the horizontal component, the first vertical component, and the second vertical component includes a channel, and wherein the first vertical component and the second vertical component each include one of a hole or a protrusion configured to be removably positioned in a corresponding one of a protrusion on a frame or a hole in the frame.

* * * * *